US008261582B2

(12) United States Patent
Graute et al.

(10) Patent No.: US 8,261,582 B2
(45) Date of Patent: Sep. 11, 2012

(54) FRONT-LOADING LAUNDRY APPLIANCE SUCH AS A WASHING MACHINE, A LAUNDRY DRYER OR A WASHER-DRYER MACHINE

(75) Inventors: Bernard Graute, Rietberg (DE); Wolfgang Hellhake, Lippstadt (DE)

(73) Assignee: Miele & Cie. KG, Guetersloh (DE)

( * ) Notice: Subject to any disclaimer, the term of this patent is extended or adjusted under 35 U.S.C. 154(b) by 1381 days.

(21) Appl. No.: 11/393,967

(22) Filed: Mar. 30, 2006

(65) Prior Publication Data

US 2006/0218975 A1 Oct. 5, 2006

(30) Foreign Application Priority Data

Apr. 4, 2005 (DE) ..... 10 2005 015 551

(51) Int. Cl.
*D06F 39/14* (2006.01)

(52) U.S. Cl. ..... 68/196; 68/24

(58) Field of Classification Search ..... 68/196
See application file for complete search history.

(56) References Cited

U.S. PATENT DOCUMENTS 6,256,823 B1 7/2001 Kronbetter et al. ..... 8/158

FOREIGN PATENT DOCUMENTS

| | | | |
|---|---|---|---|
| DE | 40 30 290 | | 3/1992 |
| EP | 1233100 | A1 * | 8/2002 |
| EP | 1 285 986 | | 2/2003 |
| EP | 1321558 | | 6/2003 |
| GB | 2 356 638 | | 5/2001 |

* cited by examiner

*Primary Examiner* — Michael Barr
*Assistant Examiner* — Jason Riggleman
(74) *Attorney, Agent, or Firm* — Leydig, Voit & Mayer, Ltd.

(57) ABSTRACT

A front-loading laundry appliance includes a housing having a substantially circular housing opening closable by a door and a drum rotatably mounted in the housing. The front end of the drum has a substantially circular drum opening for introducing or removing laundry. The drum has an at least approximately horizontal axis of rotation lying lower than a central axis of the housing opening. The housing opening has a first diameter and the drum opening has a second diameter, the first diameter being greater than the second diameter.

10 Claims, 3 Drawing Sheets

FRONT-LOADING LAUNDRY APPLIANCE SUCH AS A WASHING MACHINE, A LAUNDRY DRYER OR A WASHER-DRYER MACHINE

Priority is claimed to German patent application DE 10 2005 015 551.0, filed Apr. 4, 2005, the entire subject matter of which is hereby incorporated by reference herein.

The present invention relates to a front-loading laundry appliance, such as a washing machine, a laundry dryer, or a washer-dryer machine, including a housing, a substantially circular housing opening which is closable by a door, a suds container resiliently mounted in the housing, a drum horizontally rotating in said suds container and having a substantially circular drum opening for introducing or removing laundry, and further including a bellows seal for providing a tubular connection between the housing opening and the drum opening, the central axis of the housing opening being higher than the central axis of the drum opening.

BACKGROUND

In known laundry appliances having a front-loading opening, the housing opening is in alignment with the drum opening. In order to make loading easier, some manufacturers have been offering laundry appliances having an enlarged loading opening (also referred to as porthole) for some time. However, there are certain limits to the drum opening to ensure that not too many laundry items travel from the turning drum toward the porthole or bellows and remain there during the movement of the laundry. This risk is particularly high if the ring remaining between the drum opening and the outer drum wall is too narrow.

An example of an approach to improving accessibility is known from European Patent EP 1 285 986 B1. There, the central axis of the housing opening is spaced from and above the central axis of the drum opening. This design approach may, in fact, provide an improvement as far as a better view into the drum is concerned, but the accessibility of the drum through the relatively narrow loading opening is still in need of improvement. According to another approach described in that patent, the assembly is arranged such that it is slightly inclined, whereby the drum opening faces slightly upward. This approach is not entirely satisfactory either, because the visibility is enhanced only in the direction toward the drum end located opposite. The view into the front portion of the drum is not enhanced.

U.S. Pat. No. 6,256,823 B1 also describes a front-loading washing machine, in which the housing opening is spaced from and above the drum opening. In order to prevent laundry items from getting between the door glass and the bellows seal, the lower region of the bellows seal has a plurality of ribs formed thereon or attached thereto one behind the other, as viewed in the axial direction. However, the ribs make it more difficult for the laundry to slide along the bellows seal when loading or unloading the drum.

German Utility Model DE 200 16 977 U1 describes an elliptical housing opening which improves both access and view into the interior of the drum. However, this approach can be used only if the esthetic appearance of the design allows for it. The door requires a very high degree of dimensional accuracy with respect to shape and alignment during assembly, because slight differences in position could impair the tightness. The attachment of the bellows seal to the front wall also requires very accurate alignment, because a slight rotation would make the intended fit impossible.

It is known from German Patent Application DE 40 30 290 A1 to enlarge the housing opening of a laundry dryer. However, there, the enlarged housing opening, which is located near the deepest point of the inner surface of the drum, was found to negatively affect the loading and unloading operations. During these operations, it may occur that individual laundry items fall out of the drum.

SUMMARY OF THE INVENTION

It is, therefore, an object of the present invention to provide a laundry appliance in which access to the interior of the drum during loading and unloading is improved in a simple manner.

The present invention provides a front-loading laundry appliance, such as a washing machine, a laundry dryer, or a washer-dryer machine. The appliance includes a housing and a substantially circular housing opening which is closable by a door. A drum is rotatably mounted in the housing and has an at least approximately horizontal axis of rotation. The drum has formed in its front end a substantially circular drum opening for introducing or removing laundry, the central axis of the housing opening being higher than the axis of rotation of the drum. The housing opening has a first diameter and the drum opening has a second diameter, the first diameter being greater than the second diameter.

One advantage that can be achieved with the present invention is that it enables the user to fill and unload laundry into and from the drum while in a comfortable position. Another advantage is that an enhanced view into the drum makes it much easier to search for hidden laundry items.

In a front-loading laundry appliance, such as a washing machine, a laundry dryer, or a washer-dryer machine, including a housing in which is rotatably mounted a drum having an at least approximately horizontal axis of rotation, this is achieved by the housing having a substantially circular housing opening which is closable by a door and which is spaced parallel from and above the also circular drum opening disposed about the axis of rotation at the front of the drum. Because the housing opening has a first diameter and the drum opening has a second diameter, the first diameter being greater than the second diameter, an operator can easily reach into the interior of the drum with both hands simultaneously, for example, to remove laundry items from the drum after washing is completed.

In an embodiment providing an advantageous visual appearance, the central axis of the housing opening is parallel to the axis of rotation of the drum, i.e., to the central axis of the drum opening.

In another advantageous embodiment, the central axis is located at a higher position selected such that the lower edge of the housing opening is substantially in horizontal alignment with the lower edge of the drum opening. Because of this, the upper edge of the housing opening is noticeably higher than the upper edge of the drum opening. This allows the laundry items to be removed from the interior of the drum very easily because they do not need to be lifted higher than beyond the rim of the end wall of the drum. The same applies to the clear opening left in washing machines or washer-dryer machines which use a bellows seal having circumferential sealing lips which reduce the size of the opening.

In one suitable embodiment, the diameter of the housing opening is greater by a factor of 1.05 to 1.3 than the diameter of the drum opening. For a given drum opening having a diameter of about 30 cm, the resulting diameter of the door opening is about 32 cm. This provides good access to the interior of the drum as well as an appealing appearance.

In another suitable embodiment, the housing opening is inclined with respect to the vertical. This makes it possible to meet visual design requirements, while improving access and view into the interior of the drum. Inclination angles ranging between 5 and 10 degrees have proven advantageous with regard to the depth of the appliance.

In washing machines and washer-dryer machines, the housing opening is usually connected to the opening of the suds container by a bellows seal. The interior of the drum is accessible from the housing opening through the bellows seal.

In a suitable embodiment, the bellows seal has a plane tubular connecting portion between the housing opening and the drum opening. This connecting portion substantially provides a smooth transition from the larger housing opening to the smaller drum opening located below and parallel thereto. For this reason, the plane tubular connecting portion has the basic geometric shape of an inclined truncated cone.

BRIEF DESCRIPTION OF THE DRAWINGS

An exemplary embodiment of the present invention is shown in the drawings in a purely schematic way and will be described in more detail below. In the drawings.

DETAILED DESCRIPTION

Figure 1:
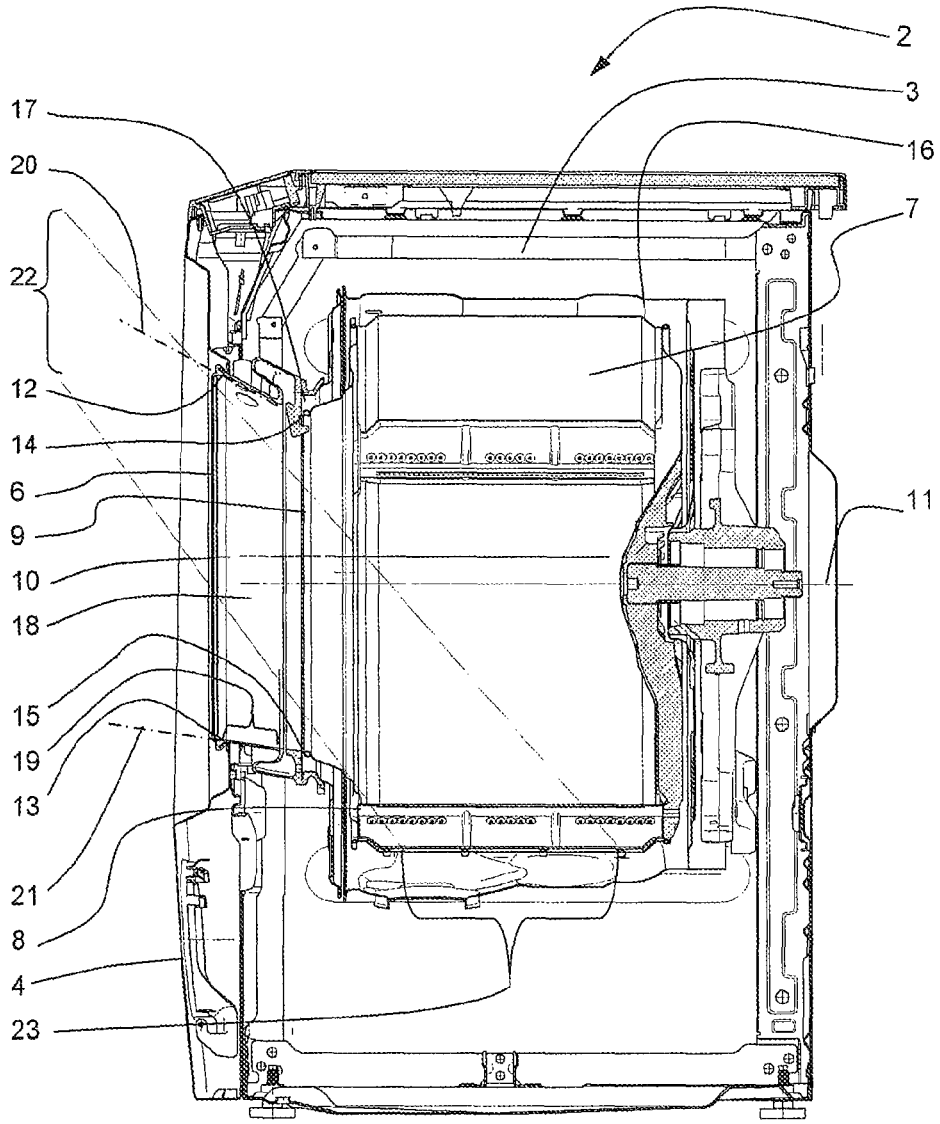
FIG. 1 shows a laundry appliance in a side view.

The side view of FIG. 1 shows a front-loading laundry appliance 2 having a housing 3 and a drum 7. Laundry appliance 2 shown here is a washing machine or a washer-dryer machine, but the following explanations also apply to a laundry dryer (not shown) which, unlike a washing machine 2 or a washer-dryer machine 2, has no bellows seal 18 and no suds container 16. Housing 3 includes a front wall 4 having a housing opening 6 that makes it possible to reach into the interior of drum 7 through drum opening 9. This is necessary in order to load drum 7 with laundry items or to remove laundry items from drum 7. The drum has a horizontal axis of rotation 11. Central axis 10 of housing opening 6 is also horizontal, but located at a higher position in axially parallel relationship therewith. Diameter dg of housing opening 6 is greater than diameter dt of drum opening 9. In the embodiment shown, since central axis 10 of the housing opening is higher than the axis of rotation 11 of the drum, the resulting loading and unloading direction is oriented upward. The upwardly widening housing opening 6 allows an operator to look into drum 7 at an increased angle 22, thus providing a view of nearly the whole bottom area 23 of the outer drum wall along its depth dimension.

FIG. 1 further shows the transition between upper edge 14 of drum opening 9 and upper edge 12 of housing opening 6, which is illustrated by transition line 20. The transition between lower edge 15 of drum opening 9 and lower edge 13 of housing opening 6 is shown by transition line 21. Lower transition line 21 is nearly horizontal or only slightly inclined, which illustrates that lower edge 13 of housing opening 6 is only slightly higher than lower edge 15 of drum opening 9. In an embodiment not shown, it is also possible for lower edge 13 of the housing opening to be in alignment with the lower edge 15 of the drum opening. In both embodiments, the laundry items need not be lifted, or need to be lifted only slightly, when removing them from the interior of drum 7.

Upper transition line 20 illustrates that upper edge 12 of housing opening 6 is located clearly above upper edge 14 of drum opening 9. Thus, the view from above and from a distance that is convenient for the operator is prevented from being obstructed or impaired.

In an embodiment, it is possible for the axis of rotation 11 of the drum to be inclined with respect to the horizontal. For further embodiments, central axis 10 of housing opening 6 may be parallel to the horizontal, or also inclined, or be parallel to an inclined axis of rotation 11 of drum 7.

Figure 2:
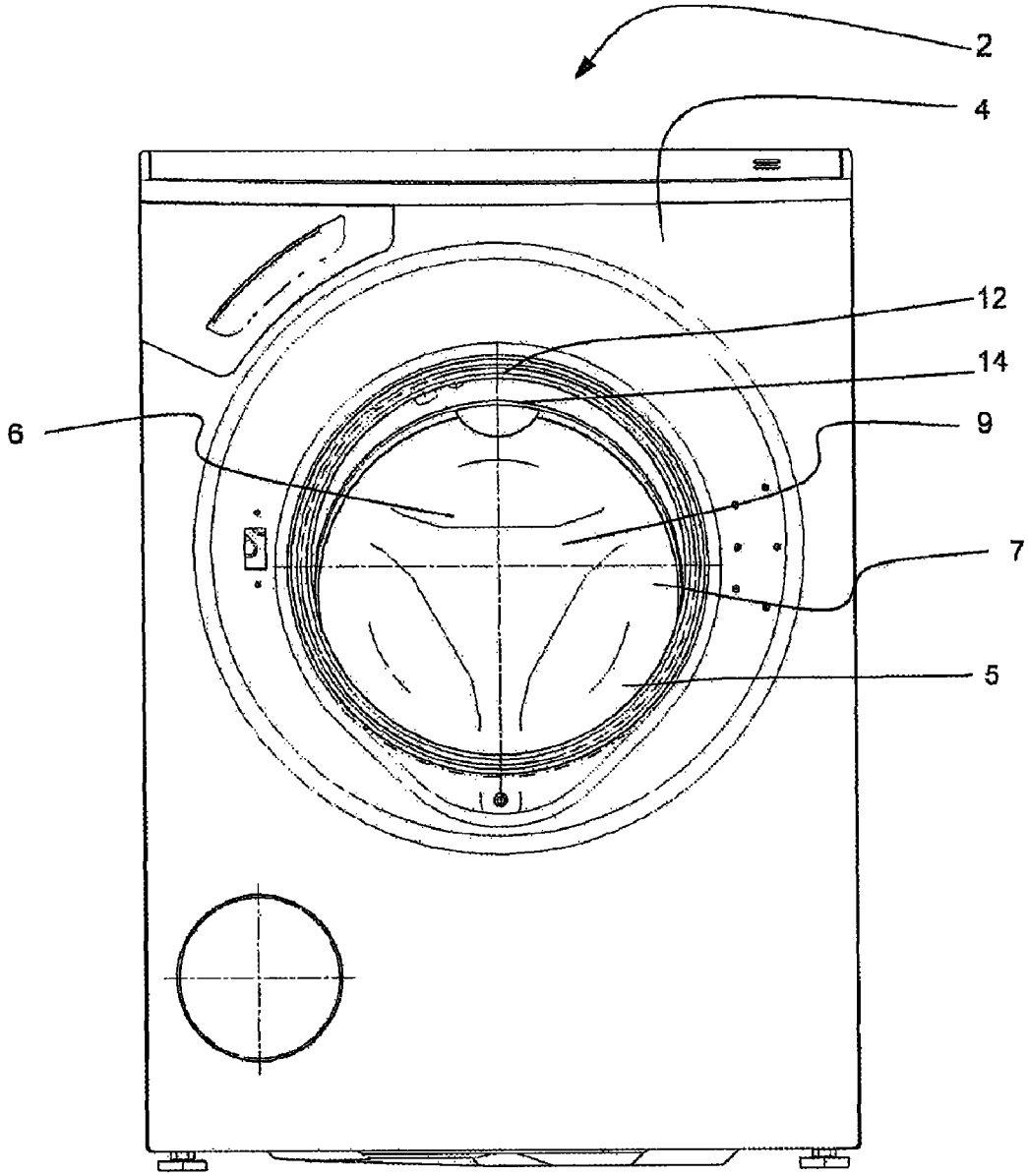
FIG. 2 shows a laundry appliance in a front view.

The front view of FIG. 2 illustrates the axially parallel arrangement of drum 7 and drum opening 9 with respect to housing opening 6. Door 5 is substantially circular in shape, which provides an advantageous visual appearance.

Figure 3:
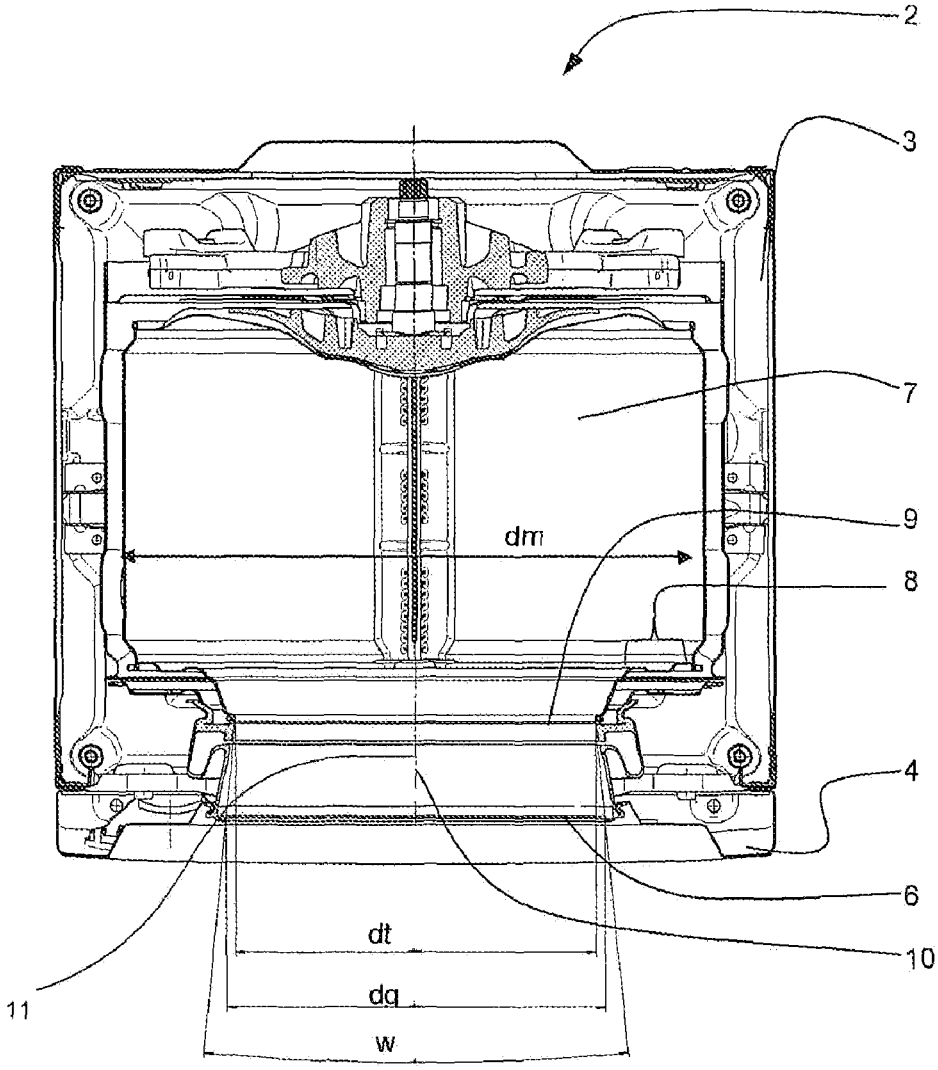
FIG. 3 shows a laundry appliance in a top view.

FIG. 3 illustrates that diameter dg of housing opening 6 is greater than diameter dt of drum opening 9, and that the two openings are substantially aligned with each other, as viewed from above. Because of the larger housing opening 6, an operator can easily reach into the interior of drum 7 with both hands, which makes it easier to remove laundry items from the interior of drum 7. This is also achieved by the fact that the projected transition of diameter dt of drum opening 9 to diameter dg of the housing opening forms an angle w. A particular advantage here is that there is no need to increase the size of drum opening 9. Thus, the ring that remains at front end 8 of the drum and whose width is essentially given by the difference between drum diameter dm and diameter dt of drum opening 9 is sized to have a width that very reliably prevents laundry items from leaving the interior of drum 7 during the washing operation.

For laundry appliances 2 with a capacity of 5 to 6 kg of laundry, which are presently widely used in domestic applications, it is advantageous that diameter dg of housing opening 6 be greater by a factor of 1.05 to 1.3 than the diameter of drum opening 9. Given a diameter dt of about 30 cm for drum opening 9, the resulting diameter dg of housing opening 6 is about 31.5 to 39 cm.

A specific embodiment for a washing machine 2 or a washer-dryer machine 2 can be seen in FIG. 1. For a washing machine 2 or a washer-dryer machine 2, drum 7 is rotatably mounted within a suds container 16. In this example, suds container 16 is oriented substantially horizontally in the axial direction. Axis of rotation 11 of drum 7 is also oriented substantially horizontally. In a front-loading washing machine 2 or washer-dryer machine 2, it is common to place a bellows seal 18 between housing opening 6 and suds container opening 17. In this embodiment, drum opening 9 is placed on the axis of suds container opening 17. Diameter dt of drum opening 9 is smaller than the diameter of suds container opening 17. Bellows seal 18 is shaped to provide a transition between housing opening 6 and drum opening 9. In this embodiment, bellows seal 18 has a tubular connecting portion 19 having substantially the shape of an inclined truncated cone. The base of the inclined truncated cone is formed by the area of circular housing opening 6. The area of the small end of the truncated cone is formed by the area of circular drum opening 9. In a laundry dryer not having a bellows seal, the projected transition of a connection between the periphery of housing opening 6 and the periphery of drum opening 9 produces the shape of an inclined truncated cone.

LIST OF REFERENCE NUMERALS

2 laundry appliance: washing machine or washer-dryer machine

3 housing

4 front wall

5 door

6 housing opening

7 drum
8 drum end
9 drum opening
10 central axis of the housing opening
11 central axis of the drum opening, axis of rotation of the drum
12 upper edge of the housing opening
13 lower edge of the housing opening
14 upper edge of the drum opening
15 lower edge of the drum opening
16 suds container
17 suds container opening
18 bellows seal
19 tubular connecting portion
20 upper transition line
21 lower transition line
22 viewing angle
23 visible area

What is claimed is:

1. A front-loading laundry appliance comprising: a housing including a substantially circular housing opening closable by a door; and a drum rotatably mounted in the housing and having in a front end thereof a substantially circular drum opening for introducing or removing laundry, the drum having an at least approximately horizontal axis of rotation being lower than a central axis of the housing opening; wherein the housing opening has a first diameter and the drum opening has a second diameter, the first diameter being greater than the second diameter; and wherein a lower edge of the housing opening is substantially in horizontal alignment with a lower edge of the drum opening.

2. The front-loading laundry appliance as recited in claim 1 wherein the housing is a housing of at least one of a washing machine, a laundry dryer, and a washer-dryer machine.

3. The front-loading laundry appliance as recited in claim 1 wherein the central axis of the housing opening is parallel to the axis of rotation of the drum.

4. The front-loading laundry appliance as recited in claim 1 wherein the first diameter is greater than the second diameter by a factor of 1.05 to 1.3.

5. The front-loading laundry appliance as recited in claim 4 wherein the first diameter is 32 cm and the second diameter is 30 cm.

6. The front-loading laundry appliance as recited in claim 1 wherein the housing opening is disposed in a plane, the plane being inclined with respect to vertical.

7. The front-loading laundry appliance as recited in claim 6 wherein the plane is inclined with respect to vertical at an inclination angle in a range between 5 and 10 degrees.

8. A front-loading washing or washer-dryer machine comprising: a housing including a substantially circular housing opening closable by a door; a suds container resiliently mounted in the housing; a drum rotatably mounted in the housing and having in a front end thereof a substantially circular drum opening for introducing or removing laundry, the drum having an at least approximately horizontal axis of rotation being lower than a central axis of the housing opening; and a bellows seal providing a connection between the housing opening and an opening of the suds container, the drum opening being accessible from the housing opening via the bellows seal; wherein the housing opening has a first diameter and the drum opening has a second diameter, the first diameter being greater than the second diameter; and wherein a lower edge of the housing opening is substantially in horizontal alignment with a lower edge of the drum opening.

9. The front-loading washing or washer-dryer machine as recited in claim 8 wherein the bellows seal includes a plane tubular connecting portion disposed in a transition between the housing opening and the drum opening.

10. The front-loading washing or washer-dryer machine as recited in claim 9 wherein the plane tubular connecting portion has substantially a shape of an inclined truncated cone.

* * * * *